US010995547B2

(12) United States Patent
Kieffer et al.

(10) Patent No.: US 10,995,547 B2
(45) Date of Patent: May 4, 2021

(54) TELESCOPING LADDER WITH A CASCADING COLLAPSE MECHANISM

(71) Applicant: Core Distribution, Inc., Minneapolis, MN (US)

(72) Inventors: Mitchell I. Kieffer, Key Biscayne, FL (US); Nathan L. Schlueter, Bloomington, MN (US)

(73) Assignee: Core Distribution, Inc., Minneapolis, MN (US)

( * ) Notice: Subject to any disclaimer, the term of this patent is extended or adjusted under 35 U.S.C. 154(b) by 234 days.

(21) Appl. No.: 16/080,206

(22) PCT Filed: Feb. 28, 2017

(86) PCT No.: PCT/US2017/019849

§ 371 (c)(1),
(2) Date: Aug. 27, 2018

(87) PCT Pub. No.: WO2017/151558

PCT Pub. Date: Sep. 8, 2017

(65) Prior Publication Data

US 2019/0055783 A1 Feb. 21, 2019

Related U.S. Application Data

(60) Provisional application No. 62/301,200, filed on Feb. 29, 2016.

(51) Int. Cl.
*E06C 1/12* (2006.01)
*E06C 7/00* (2006.01)
(Continued)

(52) U.S. Cl.
CPC ..... *E06C 1/125* (2013.01); *E06C 7/003* (2013.01); *E06C 7/086* (2013.01); *E06C 7/088* (2013.01);
(Continued)

(58) Field of Classification Search
CPC ..... E06C 1/125; E06C 7/086
See application file for complete search history.

(56) References Cited

U.S. PATENT DOCUMENTS 5,495,915 A * 3/1996 Weston ..... E06C 1/125 182/195
5,738,186 A * 4/1998 Jones ..... E06C 1/125 182/195
(Continued)

FOREIGN PATENT DOCUMENTS

CN 202194553 U 4/2012
CN 202300169 U 7/2012
(Continued)

OTHER PUBLICATIONS

International Patent Application No. PCT/US2017/019849, International Search Report and Written Opinion dated May 15, 2017, 13 pages.
(Continued)

*Primary Examiner* — Colleen M Chavchavadze
(74) *Attorney, Agent, or Firm* — Fredrikson & Byron. P.A.

(57) ABSTRACT

A telescoping ladder is provided, that includes a plurality of columns disposed in a nested arrangement for relative axial movement in a telescopic fashion between a fully-extended position and a collapsed position. The columns are connected to rungs by way of connector assemblies. Each connector assembly has a locking pin moveable between an extended position or a retracted position for extending into or retracting out of openings of adjacent columns to selectively lock or release the columns respectively. The telescoping ladder includes a plurality of actuators that permit collapsing the ladder in a sequential manner, the sequence
(Continued)

involving collapsing the columns on a lower portion of the ladder prior to collapsing columns immediately thereabove.

22 Claims, 8 Drawing Sheets

(51) Int. Cl.
*E06C 7/08* (2006.01)
*E06C 7/02* (2006.01)
*E06C 7/06* (2006.01)

(52) U.S. Cl.
CPC ..... *E06C 7/02* (2013.01); *E06C 7/06* (2013.01); *E06C 7/083* (2013.01)

(56) References Cited

U.S. PATENT DOCUMENTS 5,743,355 A * 4/1998 McDonnell ..... E06C 1/125 182/195
6,708,800 B2 * 3/2004 Kieffer ..... E06C 1/125 182/195
6,883,645 B2 4/2005 Kieffer et al.
7,048,094 B2 * 5/2006 Kieffer ..... E06C 1/125 182/195
7,316,293 B2 * 1/2008 Yao ..... E06C 1/125 182/195
8,066,099 B2 * 11/2011 Liang ..... E06C 1/125 182/195
8,225,906 B2 * 7/2012 Kieffer ..... E06C 1/125 182/195
8,387,753 B2 * 3/2013 Kieffer ..... E06C 7/088 182/195
8,622,175 B2 * 1/2014 Nielsen ..... E06C 1/125 182/195
8,869,939 B2 * 10/2014 Kuo ..... E06C 1/125 182/195
8,939,256 B2 * 1/2015 Nielsen ..... E06C 7/04 182/195
9,260,917 B2 * 2/2016 Weston ..... E06C 1/125
9,416,591 B2 * 8/2016 Kieffer ..... E06C 1/125
10,161,184 B2 * 12/2018 Lampe ..... E06C 1/125
2004/0195043 A1 * 10/2004 Johansson ..... E06C 1/125 182/195
2006/0283665 A1 * 12/2006 Yao ..... E06C 1/18 182/195
2007/0209875 A1 * 9/2007 Chen ..... E06C 1/125 182/195
2008/0164097 A1 * 7/2008 Eriksson ..... E06C 1/22 182/22
2009/0050407 A1 * 2/2009 Eriksson ..... E06C 1/18 182/195
2011/0192679 A1 8/2011 Kuo et al.
2012/0267197 A1 10/2012 Kieffer et al.
2018/0128049 A1 * 5/2018 Parker ..... E04F 11/068

FOREIGN PATENT DOCUMENTS

CN 103492658 A 1/2014
DE 202012100555 U1 3/2012
EP 527766 B1 6/1996
EP 2343433 A1 7/2011
EP 2634360 A1 9/2013
EP 3147447 A1 3/2017
WO 9115651 A1 10/1991

OTHER PUBLICATIONS

European Patent Application No. 17158576.3, Extended European Search Report dated May 15, 2017, 9 pages.

* cited by examiner

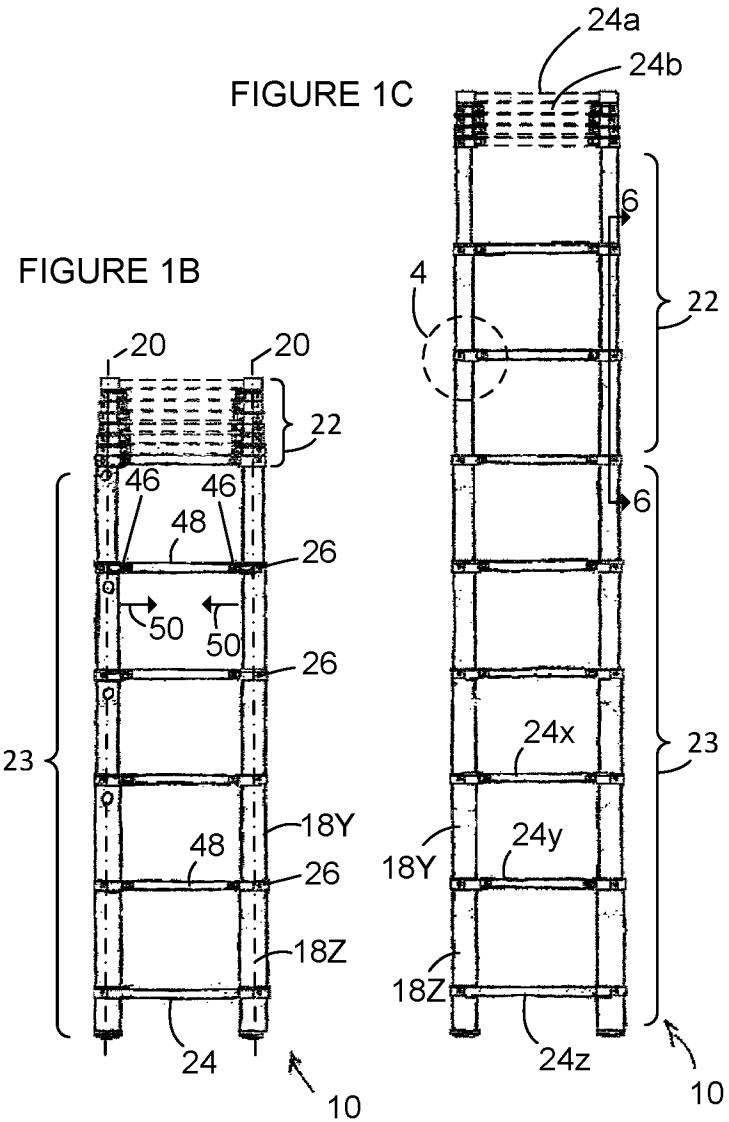
FIGURE 1C
FIGURE 1B
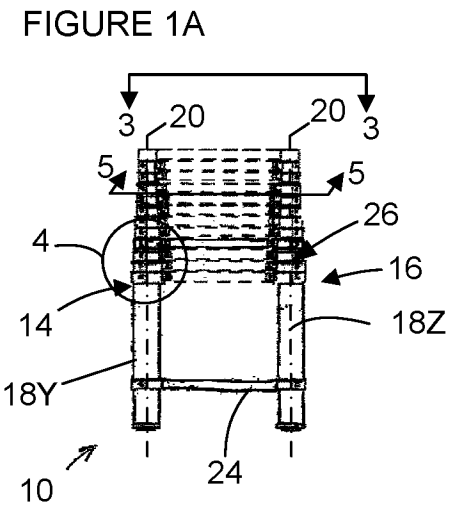
FIGURE 1A

TELESCOPING LADDER WITH A CASCADING COLLAPSE MECHANISM

RELATED APPLICATION

This application is a 35 U.S.C. 371 national stage filing from International Application No. PCT/US2017/019849, filed Feb. 28, 2017, which claims priority to U.S. Provisional Application, 62/301,200, filed on Feb. 29, 2016. The entire contents of all of these applications are incorporated by reference in their entirety.

BACKGROUND

Ladders typically include rungs supported between stiles formed from a plurality of columns. In some cases, the ladder can be a telescoping ladder and can be expanded to separate the columns from one another for extension of the ladder, or collapsed together for retraction of the ladder.

SUMMARY

In one aspect this disclosure provides a telescoping ladder, comprising a plurality of columns disposed in a nested arrangement for relative axial movement in a telescopic fashion along an axis of the plurality of columns between a fully-extended position and a collapsed position connected to a plurality of rungs by a plurality of connector assemblies. Each connector assembly comprises a locking pin moveable between an extended position or a retracted position for extending into or retracting out of openings of adjacent columns to selectively lock or release the columns respectively. The telescoping ladder comprises a plurality of actuators, each actuator being operatively coupled to a corresponding locking pin such that when actuated, the corresponding locking pin moves from the extended position to the retracted position. Each actuator can have a ramp surface permitting travel of a shoulder portion of the corresponding locking pin, such that a movement of each actuator in a direction parallel to the axis of the plurality of the columns is coupled to a movement of the corresponding locking pin between the extended position and the retracted position in a direction perpendicular to the axis of the plurality of columns, to lock or release the adjacent columns. In such embodiments, the plurality of actuators permit collapsing the ladder in a sequential manner, the sequence involving collapsing the columns on a lower portion of the ladder prior to collapsing columns immediately thereabove.

In another aspect, each locking pin can be operatively coupled to a release button. In such cases, each ramp surface may permit travel of a portion of a corresponding release button thereon, such that a movement of each actuator in a direction parallel to the axis of the plurality of the columns is coupled to a movement of the corresponding release button between the extended position and retracted position in a direction perpendicular to the axis of the plurality of columns, to lock or release the adjacent columns, In a further aspect each actuator has a bottom wall, and a pair of side walls perpendicular to the bottom wall. The pair of side walls of each actuator comprises a ramp surface recessed therefrom. Each locking pin may have a transverse pin passing therethrough. The transverse pin may ride on the ramp surface of a corresponding actuator so as to provide a direct or indirect slidable engagement of the locking pin and the corresponding actuator, whereby the slidable engagement of each locking pin and the corresponding actuator permits retraction of each locking pin so as to permit relative axial movement between the adjacent columns connected to each locking pin, The details of one or more examples are set forth in the accompanying drawings and the description below. Other features, objects, and advantages will be apparent from the description and drawings, and from the claims.

BRIEF DESCRIPTION OF DRAWINGS

FIG. 1A is a perspective view of a telescoping ladder according to an embodiment with the rungs shown in a collapsed position;

FIG. 1B is a perspective view of the telescoping ladder of FIG. 1A with the rungs in a lower portion of the ladder shown in an extended position;

FIG. 1C is a perspective view of the telescoping ladder of FIG. 1A, with the rungs of a lower portion of the ladder shown in an extended position;

DETAILED DESCRIPTION

Figure 2A:
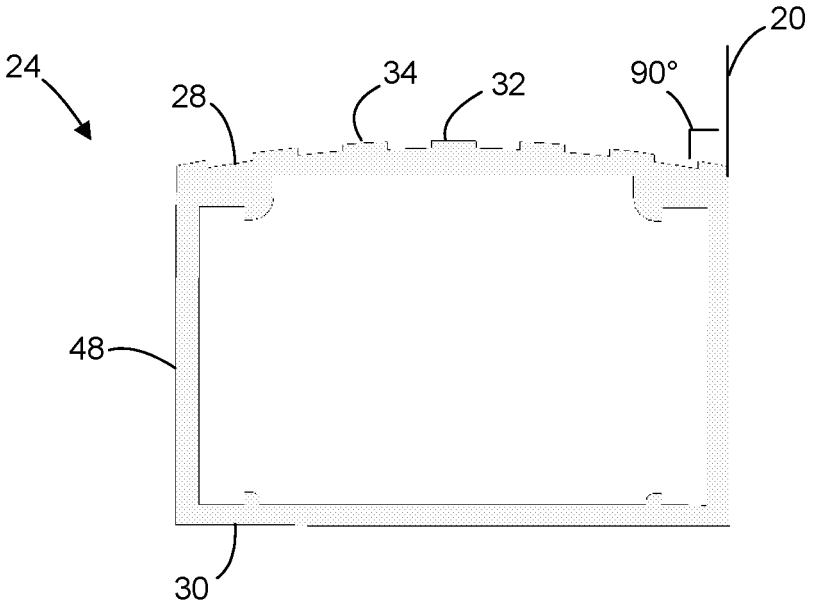
FIG. 2A is a cross-sectional view of the rungs of the telescoping ladder of FIG. 1A.

FIG. 1A is a perspective view of a telescoping ladder 10 according to an embodiment. Referring to FIG. 1A, the telescoping ladder 10 comprises a first stile 14 and a second stile 16 (e.g., left hand and right hand stiles illustrated in FIG. 1A). The first and second stiles each have a plurality of columns 18 disposed in a nested arrangement for relative axial movement in a telescopic fashion along a longitudinal axis 20 of the plurality of columns 18 between an extended position and a collapsed position. For instance, in FIG. 1B, an upper portion 22 of the ladder 10 is shown in a collapsed position where the columns 18 are nested within each other along the longitudinal axis 20 of the columns 18 in a telescoping fashion while the lower portion 23 is shown in an extended position. In FIG. 1C, the upper portion 22 of the ladder 10 is shown in an extended position.

As seen in FIG. 1A-1C, the ladder 10 comprises a plurality of rungs 24 extending between the first stile 14 and the second stile 16. Each rung 24 can be connected to a column 18 of the first stile 14 and a column 18 of the second stile 16. As shown in FIG. 1A, each rung 24 can be connected to the columns 18 by a connector assembly 26 as will be described later. With continued reference to FIG. 1A, in some cases, each rung 24 comprises a planar first surface 28 and a planar second surface 30 opposite to the planar first surface 28. The first surface 28 of each rung 24 defines a planar standing surface 32. Referring to FIG. 1C, when the ladder 10 is extended for use and leaned against a wall, a user may step on the planar first surface 28. The planar standing surface 32 may comprise treads 34 (best seen in FIG. 2A) defined thereon to provide friction between the planar standing surface 32 and the contact surface of a user (e.g., soles of the user's shoes).

As will be described further, the rungs 24 can be substantially hollow so as to allow a connector assembly 26 to fasten the rung 24 to a column 18 on each of the right-hand stile and left-hand side stile. Additionally, the hollow body of the rungs 24 allow a pair of latch assemblies (not shown) to be housed in the rung 24 to connect the rung 24 to a column 18. The rungs 24 can be extruded from aluminum, although other materials and means of manufacturing can also be used.

Figure 2B:
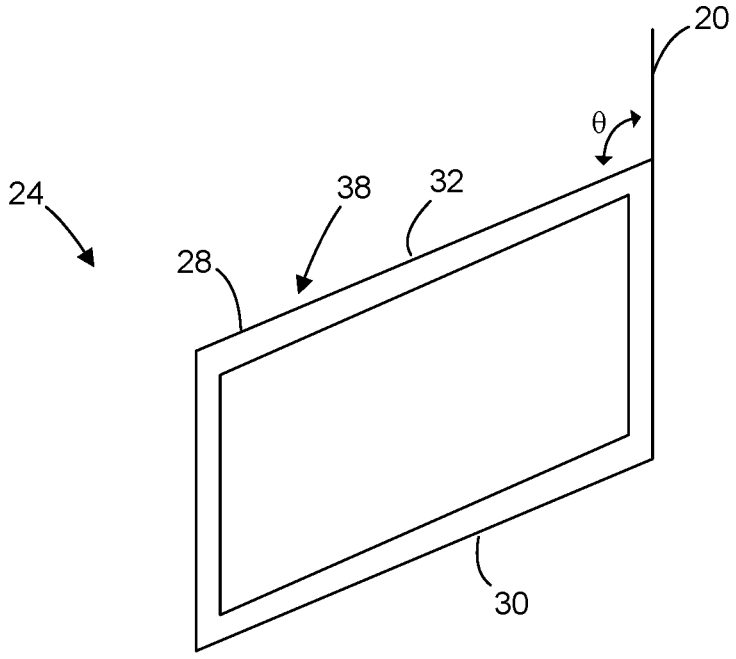
FIG. 2B is a cross-sectional view of the rungs of a telescoping ladder according to another embodiment.

Rungs 24 can have a substantially rectangular cross-section or a parallelogram cross-section such as those illustrated in U.S. Publication No. 2012/0267197 A1, assigned to the assignee of the instant application, the disclosure of which is hereby incorporated by reference in its entirety. While the illustrated FIG. 2A shows a substantially rectangular rung 24 wherein the planar first surface 28 of the rung 24 forms an angle of about 90 degrees with the longitudinal axis 20 of the stile, FIG. 2B illustrates a rung 24 having a parallelogram cross-section having at least a portion 38 of the first surface 28 (and optionally the second surface 30) that forms an angle θ with respect to the longitudinal axis 20 of the stile, and the front surface 48 (as well back surface) is parallel to the longitudinal axis 20 of the stile. The angled portion 38 can form an angle between about 95 degrees and 145 degrees (e.g., between 95 degrees and 110 degrees) with respect to the longitudinal axis 20 of the stile. Instead of a parallelogram shaped rung 24 shown in FIG. 2B, the rungs 24 of FIGS. 1A-1C can have an angled portion attached to or integrally formed with the planar first surface 28 of the rung 24. Such embodiments allow at least the angled portion of the first surface 28 of the rung 24 to be horizontal when the ladder 10 is rotated toward a vertical wall (e.g., propped against a wall at an angle) so that during normal use, at least a portion 38 of the rung 24 can be nearly horizontal. However, depending on the angle at which the ladder 10 is propped against a vertical wall, the angled portion 38 may be past or short of being horizontal.

In some embodiments, the columns 18 are made of aluminum. Other materials are contemplated and are within the scope of the invention. The columns 18 are illustrated as having a circular cross-section (when viewed along the longitudinal axis 20 of the columns 18). However, the columns 18 can have a rectangular cross-section such as those illustrated in U.S. Publication No. 2012/0267197 A1 assigned to the assignee of the instant application, the disclosure of which is hereby incorporated by reference in its entirety. Other cross-sections (e.g., square, oval or polygonal shapes) are also contemplated. The columns 18 can be substantially hollow to receive another column 18 from above.

As described above and referring to FIG. 3, the rungs 24 are connected to the columns 18 by a plurality of connector assemblies 26. Each connector assembly 26 has a collar portion 52 for generally surrounding and or contacting a column 18, and a rung portion 54 integrally formed with the collar portion 52. The rung portion 54 is held within (e.g., by friction fit) the hollow body of a rung 24. The connector assemblies 26 can have latch assemblies housed in the hollow portion 45 of each rung 24 to unlock or selectively lock relative axial movement between adjacent columns 18. Such connector assemblies 26 are described in U.S. Pat. No. 8,387,753 B2 and U.S. Pat. No. 6,883,645 both assigned to the assignee of the instant application, the disclosure of each of which is hereby incorporated by reference in its entirety. The connector assemblies 26 can be substantially identical although the connector assemblies 26 of the left-hand stile are mirror images of connector assemblies 26 of the right-hand stile. The latch assembly has a release button 46 that can be manually actuatable to unlock the selectively locked relative axial movement between two adjacent columns 18. In some cases, the release button 46 may be provided on every connector assembly 26. In other examples, the release button may be provided on the lowermost connector assemblies (e.g., the connector assembly connecting to the columns 18Y and/or 18Z closest to the floor surface). The release buttons 46 are insertable within a locking pin 56 as will be described further below, and extend out of a slot 27 of the rung 24. In the embodiment shown in FIG. 1A, the release buttons 46 may be slid inwardly along a front surface 48 of rung 24 (e.g., by the thumbs of the user), to unlock their respective latch assemblies. Thus, when release buttons 46 on both the right and left hand sides of rung 24 are slid inwardly along the illustrated arrow 50 adjacent columns 18 are permitted to move axially along the longitudinal axis 20 of the stiles to collapse or extend. While the illustrated embodiment shows buttons on the front surface 48 of the rung 24, the buttons can additionally be on rear surface (oppositely oriented to the front surface 48) or bottom surface. Alternatively the connector assembly 26 may be formed without a button. Gravity can cause such columns 18 and their rung 24 to collapse downward to assume a position similar to rungs 24 shown in the collapsed portion of the ladder 10 shown in FIG. 1A.

Figure 3:
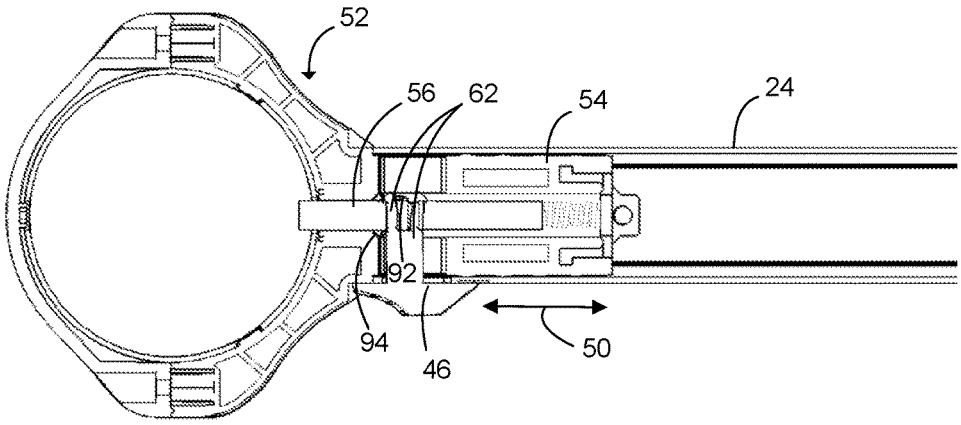
FIG. 3 is cross-sectional elevation view of a portion of the column, connector assembly, and rung taken along the sectional plane 3-3.

FIG. 3 shows a cross-sectional view taken along the plane 3-3 of a representative column 18, rung 24 and connector assembly 26. As is apparent to one skilled in the art, the connector assembly 26 is generally similar to those described in the commonly-assigned patents, U.S. Pat. No. 8,387,753 B2 and U.S. Pat. No. 6,883,645, and a detailed description thereof is omitted for brevity. As shown in FIG. 3, the latch assembly comprises a locking pin 56 that can be retracted from or extended into corresponding openings 64 (best seen in FIG. 5) on the connector assembly 26 and openings 66 columns 18 to release or selectively lock adjacent columns to each other. Returning to FIG. 3, the locking pin 56 can be connected to the release button 46 such that the sliding motion of the release button 46 along the front surface 48 of the rung 24 results in extending the locking pin 56 into or retracting the locking pin 56 out of the openings 64 of the connector assembly 26 and openings 66 of the columns 18. As perhaps best seen in FIG. 5, the locking pin 56 has a pair of apertures 60 on its outer surface.

The release button 46 comprises a shoulder portion 62 formed as a pair of tabs that engage (e.g., by friction fit) with the apertures 60 of the locking pin 56, such that sliding the release button 46 along the front surface 48 of the rung 24 in the direction 50 shown in FIG. 3 slides the locking pin 56 into or out of the openings 64 of the connector assembly 26 and the openings 66 of the columns 18 in a cooperative fashion.

As is apparent to one skilled in the art, telescoping ladders such as the ones described herein may have to be collapsed and extended without posing significant safety hazards during their normal use. For example, several countries may have safety regulations to comply with which, the ladder 10 may collapse in a cascading fashion. For instance, according to some such embodiments, the ladder 10 may collapse such that the rungs 24 (e.g., second to last rung 24) on the lower portion 32 of the collapse first in sequence, followed by the rungs 24 thereabove. Accordingly, some embodiments disclosed herein include collapsing mechanisms 70 that permit telescoping ladders to comply with such safety regulations.

Figure 4:
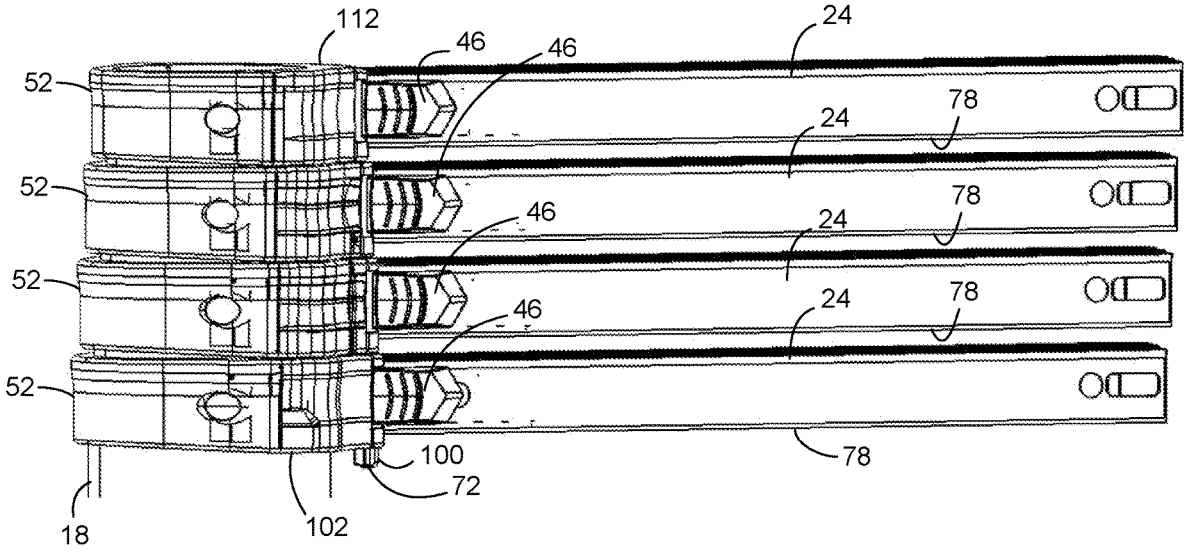
FIG. 4 is a front perspective view of a portion of the columns of the ladder of FIG. 1.

FIG. 4 shows an enlarged perspective view of the portion 4 of the telescoping ladder 10 circled in FIG. 1A wherein adjacent rungs 24 are in a generally collapsed state. In FIG. 4, the right side connector assembly 26 and columns 18 are removed for clarity. The operation of the right side connector assembly 26 and the collapsing mechanism 70 function similar to and are mirror images of the connector assembly 26 and the collapsing mechanism 70 of the left side. The collapsing mechanism 70 permits collapsing the columns 18 in a sequential manner. For instance, the collapsing mechanism 70 allows the lowermost rung 24*z* (or rung 24*y* immediately above the lowermost rung 24*z*) to be in the collapsed position followed by the rung 24*y* (or 24*x*) thereabove until generally all or all except the top few rungs 24 (e.g., topmost 24*a* and rung 24 below the topmost 24*b* are collapsed). When collapsed, the collapsing mechanism 70 according to some embodiments can permit the collar portion 52 of connector assemblies 26 of adjacent collapsed columns 18 to rest flush against each other. Similarly the columns 18 rest within one or more columns 18 therebelow such that a substantial length (e.g., between about 60% and about 95% of the length) of a column 18 is received by an adjacent column 18 therebelow.

Figure 5:
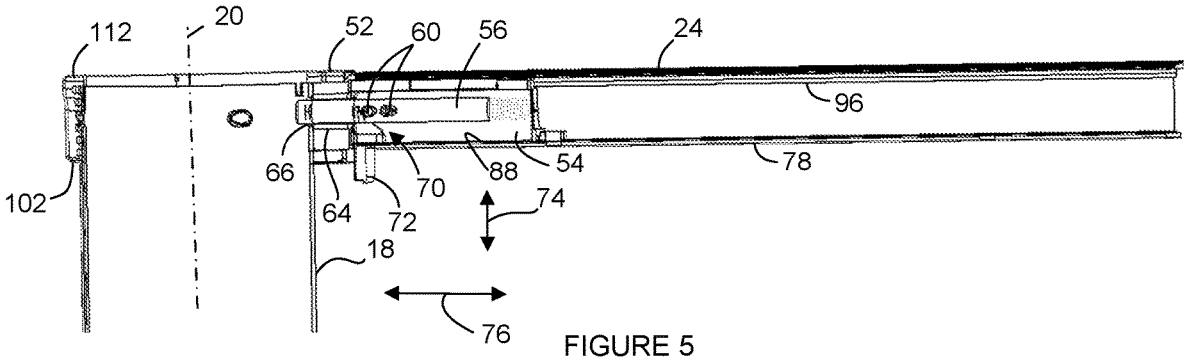
FIG. 5 is a cross-sectional view of the telescoping ladder shown in the collapsed position with the locking pin locking the column to prevent relative axial movement, taken along the sectional plane 5-5.
Figure 6:
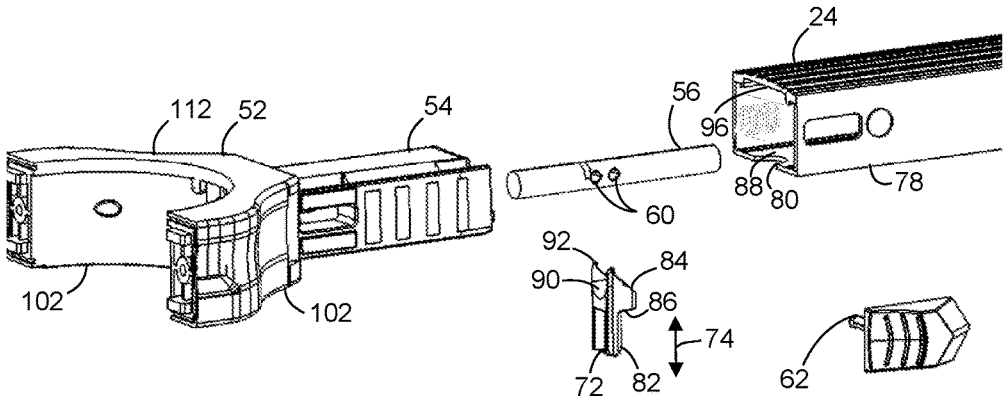
FIG. 6 is an exploded perspective view of the collapsing mechanism.

FIGS. 5 and 6 illustrate respectively, a cross-sectional front view and an exploded perspective view of the collapsing mechanism 70 according to some embodiments of the present disclosure. The collapsing mechanism 70 permits the columns 18 to collapse in a cascading fashion. The collapsing mechanism 70 comprises a actuator 72 that rests inside the hollow body of each rung 24 or on selected rungs 24 (e.g., except the topmost 24*a* and the bottom-most 24*z* rungs 24). As shown in FIG. 5, the actuator 72 protrudes past the outer bottom surface 78 of the rung 24 through a slot 80 on the bottom surface of the rung 24. The actuator 72 co-operatively engages with the locking pin 56 such that movement of the actuator 72 in a vertical direction 74 (e.g., parallel to the axis 20 of the columns) is coupled to the movement of the locking pin 56 in the inward-outward direction 76 (e.g., perpendicular to the axis 20 of the columns), as will be explained further below.

As is apparent, from FIGS. 5 and 6, the coupling of the locking pin 56 with the release button 46 is separate from the coupling of the locking pin 56 with the actuator 72. For instance, as described previously, the locking pin 56 has apertures 60 that receive the shoulder portion 62 of the release button 46. In contrast, the actuator 72 and the locking pin 56 can have an indirect engagement by way of a slidable engagement of the release button 46 relative to the actuator 72.

Figure 7:
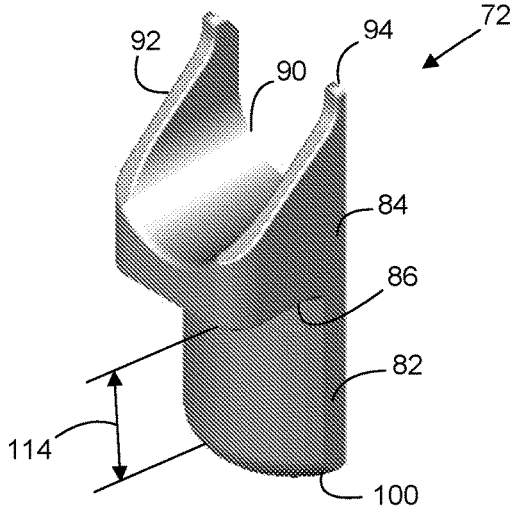
FIG. 7 is a perspective view of a actuator of the collapsing mechanism according to an embodiment.

FIG. 7 is an exploded perspective view of the actuator 72 according to an embodiment. The actuator 72 comprises a leg portion 82 that is received by a slot 80 on the rung 24 (shown in FIG. 6), and a body portion 84 supported by the leg portion 82. The body portion 84 meets the leg portion 82 and defines a ledge 86. In FIG. 5, the ledge 86 of the actuator 72 rests flush against the inner bottom surface 88 of the rung portion 54 of the connector assembly 26, although as will be explained below, the actuator 72 may be movable such that the ledge 86 may move above the inner bottom surface 88 of the rung portion 54 of the connector assembly 26 in some cases.

Referring back to FIGS. 5 and 7, the actuator 72 and the release button 46 may not be physically connected to each other, such that the when the release button 46 is slid outwardly to extend the locking pins 56 to protrude into the openings 64 of the connector assembly 26 and openings 66 of the columns 18, the locking pin 56 moves or slides relative to the actuator 72.

Referring to FIG. 7, the body portion 84 of the actuator 72 is forked such that it creates a passage 90 for having the locking pin 56 rest therein when the columns 18 are unlocked, as will be described further below. In the illustrated embodiment, the passage 90 is shaped in a generally semi-cylindrical shape to accommodate the generally cylindrical locking pin 56. However, the illustrated shape of the passage 90 in the actuator 72 and that of the locking pin 56 should not be construed as limiting and other shapes of the locking pin 56 and passage 90 of the actuator 72 are also contemplated.

Continuing with FIG. 7, the body portion 84 of the actuator 72 comprises a ramp surface 92 that is generally sloped from an upper end 94 of the actuator 72 toward the ledge 86. Referring back to FIG. 6, the actuator 72 is positioned in the hollow body of the rung 24 such that the upper end 94 is near the inner top surface 96 of the rung 24, and the ledge 86 is near or rests flush against the inner bottom surface 88 of the rung portion 54 of the connector assembly 26 when the locking pin 56 is extended to selectively lock adjacent columns. The ramp surface 92 faces away from the collar portion 52 of the connector assembly 26. As described previously, when the release button 46 is slid to protrude the locking pin 56, at least portions (e.g., shoulder portion 62) of the release button 46 can ride on the ramp surface 92. While FIG. 8 does not illustrate the release button 46 in the sectional view, one skilled in the art would recognize from the cooperative engagement of the release button 46 with the apertures 60, and the position of the apertures 60 relative to the ramp surface 92 would imply at least portions of the release button 46 riding on the ramp surface 92.

The movement of the release button 46 may result in movement of the locking pin 56 relative to the ramp surface 92 of the actuator 72. As is apparent, the movement of the locking pin 56 may be as a result of the release button 46 connected thereto riding on the ramp surface 92. For instance, as seen in FIG. 3, ends of the shoulder portion 62 pass through apertures 60 on the locking pin 56 and extend outside thereof, and engage with the ramp surface 92. In FIG. 3, the ends of the shoulder portion 62 are positioned near the upper end 94 of the actuator 72. In some such examples, an upward movement of the actuator 72 relative to the bottom surface of the rung 24 from which it protrudes may result in the locking pin 56 retracting from the openings 64 of the connector assembly 26 and openings 66 of the column 18.

Figure 8:
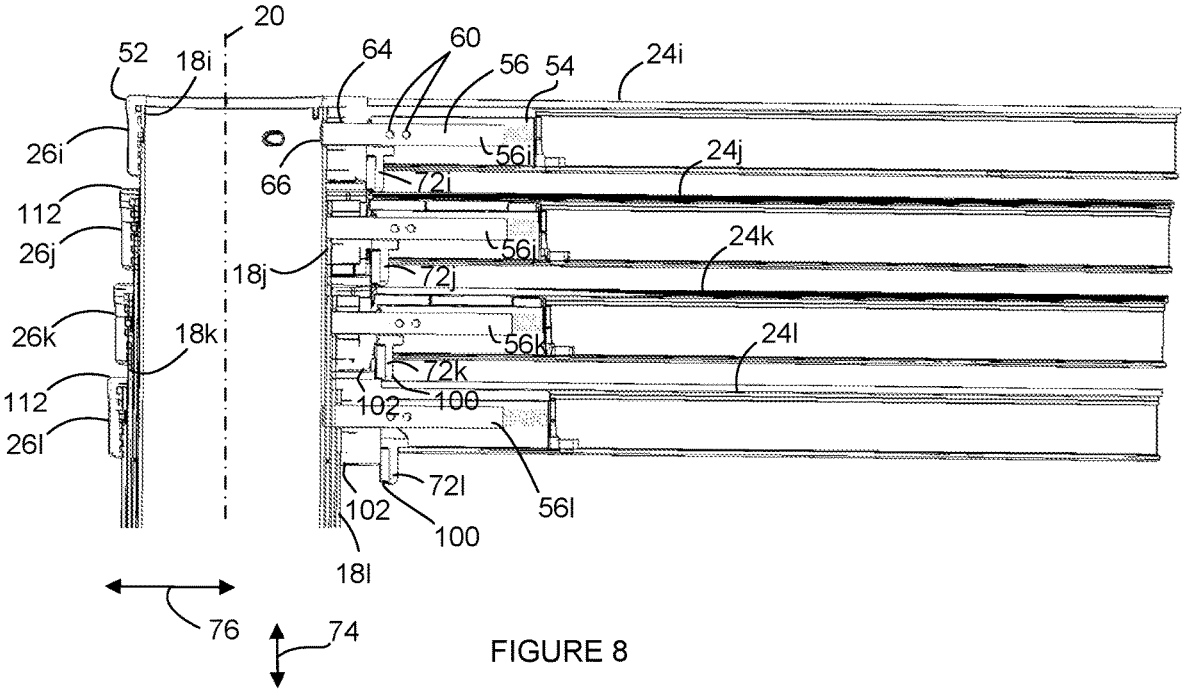
FIG. 8 is a cross-sectional view of a portion of the telescoping ladder in the collapsed position, taken along the sectional plane 8-8.

FIG. 8 illustrates a cross-sectional view of four rungs 24*i*, 24*j*, 24*k*, 24*l*, four columns 18*i*, 18*j*, 18*k*, 18*l* and associated connector assemblies 26*i*, 26*j*, 26*k* and 26*l*. In the illustrated embodiment, the columns 18*k* and 18*l* are is locked by the locking pin 56*l*, whereas the columns 18*i* and 18*j* thereabove are unlocked to freely slide relative to adjacent columns. FIG. 8 merely illustrates the position of the actuator 72 when the columns 18 are locked and unlocked, and the illustration of the order in which the columns 18 are collapsed or extended should not be construed as limiting. In the illustrated embodiment shown in FIG. 8, the rung 24*l* can be the rung 24 that is closest (e.g., relative to the rungs 24 thereabove) to the floor surface on which the ladder 10 is placed. Alternatively, the rung 24*l* can be the rung 24 immediately above the bottom-most rung 24*z*.

As referred to previously, the locking pin 56 and the actuator 72 can co-operatively engage such that the movement of the actuator 72 in a direction parallel to the axis 20 of the columns is coupled to a movement of the locking pin 56 in a direction perpendicular to the axis 20 of the column. In the illustrated embodiment, the movement of actuator 72 in a vertical direction 74 (parallel to the axis 20 of the columns) is coupled to the movement of the locking pin 56 in the inward-outward direction 76. For instance, the release button 46 can have a frictional fit with the actuator 72. Further, when locking pin 56 extends into an opening of the column 18 and the connector assembly 26 such that the columns 18 are locked, the outer surface of the locking pin 56 can rest against the passage 90 defined in the actuator 72 when the columns 18 are unlocked.

In the position seen in FIG. 8, with the exception of the locking pin 56*l*, the locking pins 56*i*, 56*j* and 56*k* are unlocked and rest against bottom portion the passage 90 defined in the actuator 72. The locking pin 56*l*, however, travels against the ramp surface 92 of the actuator 72*l* when the shoulder portion 62 of its release button 46 (not shown in FIG. 8) rides on the ramp surface 92. The locking pin 56*l* may then protrude into the openings 64 defined on the connector assembly 26*l* and the columns 18*k* and 18*l*, and therefore does not contact or rest against bottom portion of the passage 90 defined in the actuator 72*l*.

Continuing with the view illustrated in FIG. 8, the ledge 86 of the actuator 72*l* rests generally against the inner bottom surface 88 of the rung portion 54 of the connector assembly 26*l* when the locking pin 56 locks relative axial movement between adjacent columns 18*k* and 18*l*. Accordingly, the leg portion 82 of the actuator 72*l* protrudes further below the outer bottom surface 78 of the rung 24, unlike the actuators 72*i*, 72*j* and 72*k* thereabove. For instance, a lower edge 100 of the upper three actuators 72*i*, 72*j* and 72*k* illustrated in FIG. 8 are generally level with a lower edge 102 of the connector assemblies 26*i*, 26*j* and 26*k*, whereas the lower edge 100 of the actuator 72*l* hangs further below the lower edge 102 of the connector assembly 26*l*.

Figure 9:
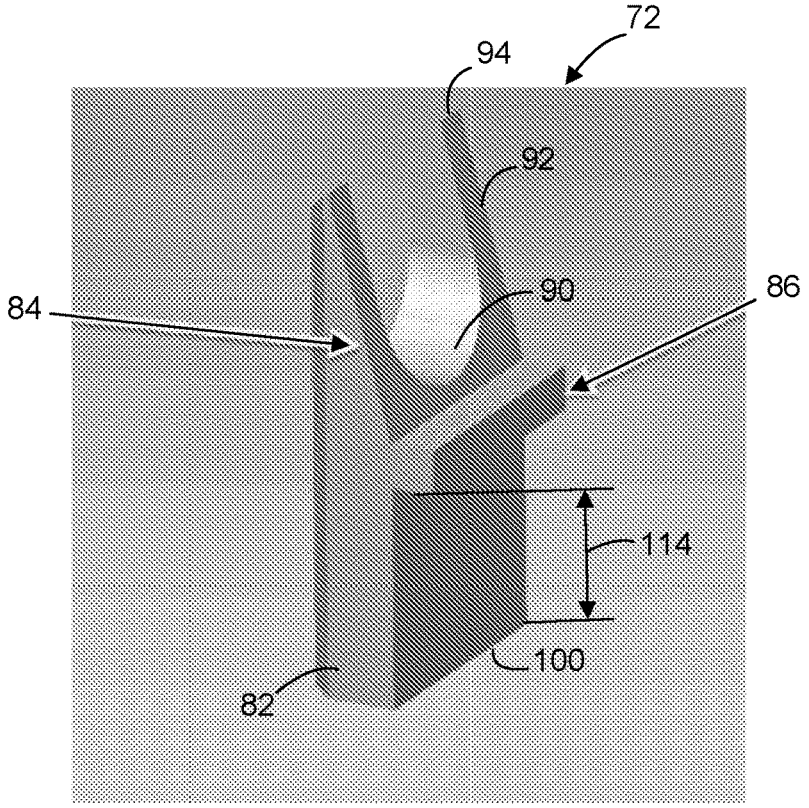
FIG. 9 is a perspective view of a actuator of the collapsing mechanism according to another embodiment.
Figure 10:
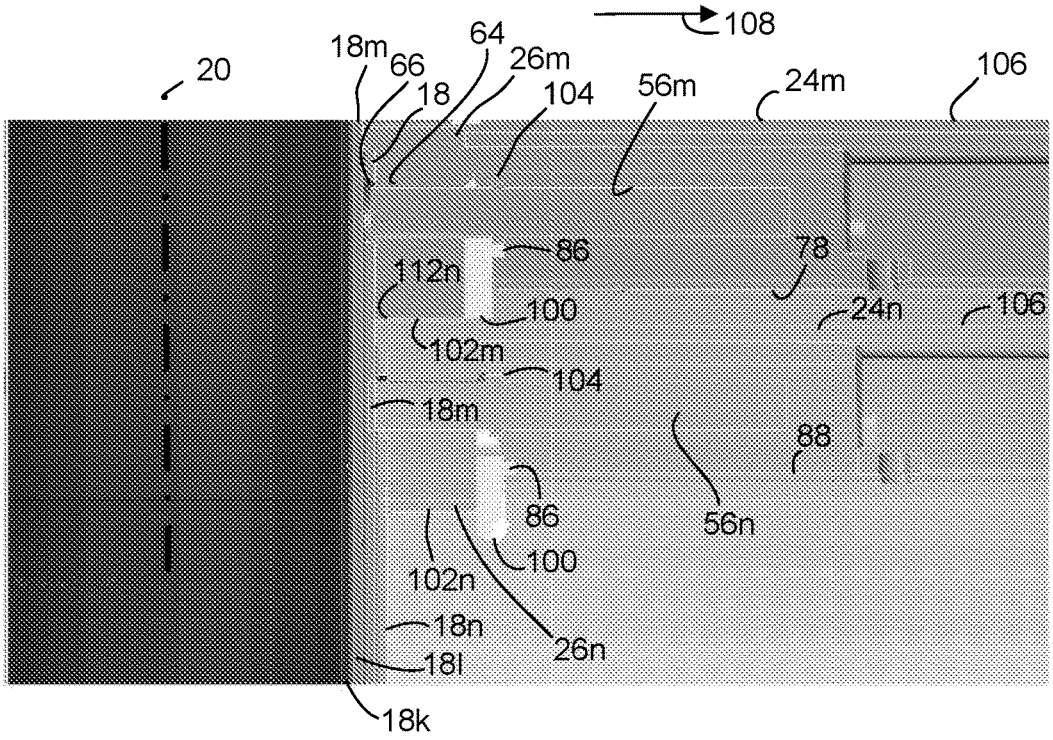
FIG. 10 is a cross-sectional view of a portion of the telescoping ladder in the collapsed position, taken along the sectional plane 10-10.
Figure 11:
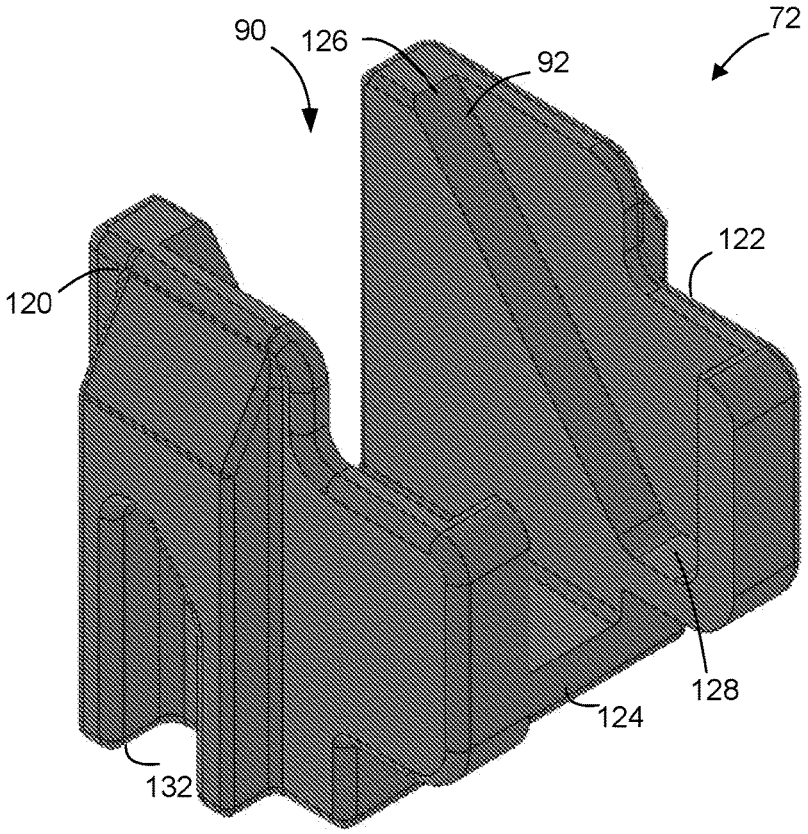
FIG. 11 is a perspective view of an actuator according to another embodiment.

FIGS. 9 and 10 refer to a collapsing mechanism 70 according to another embodiment. The collapsing mechanism 70 shown in FIGS. 9 and 10 is substantially similar to that described in FIGS. 3-8, with the exceptions described below. In FIGS. 9 and 10, the bottom locking pin 56*n* is extended to lock the columns 18*n* and 18*m*, whereas the top locking pin 56*m* is retracted and the columns 18*k*, 18*l* and 18*m* can slide relative to each other. The locking pins 56 illustrated in FIGS. 9 and 10 each include a shoulder portion 62 formed as a protrusion 104 configured for resting against the ledge 86 of the actuator 72 when the locking pin 56*m* is retracted to permit selective axial motion between adjacent columns.

In use, the collapsing mechanism 70 allows to collapse the ladder 10 in a cascading fashion. In this example, the bottom-most column 18*n* of FIG. 8 may be closer to the floor surface relative to the columns 18*k*, 18*l* and 18*m*, and therefore column 18*n* is not collapsed further into another column 18 therebelow. For instance, in FIG. 8, the ladder is collapsed by sliding the release button 46*n* of the left and right side connector assemblies 26*n* inwardly along the front surface 48 of the rung 24*n*. As a result, the column 18*m* immediately above column 18*n* and the rung 24*m* connected thereto slides downwardly into column 18*n*. During the downward sliding motion, the actuator 72*m* immediately above the column 18*m* (in the locked orientation shown in FIG. 5, with its ledge 86 flush against the inner bottom surface 88 of the rung portion 54 of the connector assembly 26) abuts the outer top surface 106 of rung 24*n*. As it abuts the outer top surface 106 of the rung 24*n*, it is pushed upward and moves generally upwards in a direction parallel to the axis 20 of the columns, and into the hollow body of the rung 24*m*, such that the ledge 86 of the actuator 72*m* is no longer flush against inner bottom surface 88 of the rung portion 54 of the connector assembly 26*m*. As the actuator 72*m* moves generally upwards, the frictional fit against the ramp surface 92 of the actuator 72*m* and the shoulder portion 62 of the release button 46 connected to the apertures 60 of the locking pin 56*m* is no longer maintained, causing the locking pin 56*m* to retract in the direction 108. As the locking pin 56*m* retracts, the column 18*m* and column 18*l* locked by the locking pin 56 are released, causing column 18*l* and the rung 24 (not shown) connected thereto to slide in a generally downward direction. The actuator 72 (not shown in FIG. 8) of that column 18 and rung 24 abuts the outer top surface 106 of the rung 24, and the cascading collapse process is repeated until generally all the columns 18 (e.g., except the topmost column 18 and rung 24 connected thereto, or top two or three columns 18 and rungs 24 connected thereto) collapse into the columns 18 below.

As the columns 18 and rungs 24 collapse in a cascading fashion, the lower edge 102*m* of the collar portion 52 of the connector assembly 26*m* above rests flush against the upper edge 112*n* of the collar portion 52 of the connector assembly 26*n* therebelow. The leg portion 82 of the actuators 72 can in some cases be of a height 114 that corresponds to the distance between the outer bottom surface 78 of the rung 24 and the lower edge 102 of the collar portion 52 of the connector assembly 26 when the columns 18 are in a collapsed position. In this case, referring back to FIGS. 7 and 9, the height 114 of the actuators 72 can be defined as the distance between the ledge 86 and lower edge 100 of the actuator 72. Such embodiments allow the ledge 86 to rest flush against the inner bottom surface 88 of the rung portion 54 when the locking 56 is in the extended state and the columns 18 are locked.

In some cases, as shown in the illustrated embodiment of FIGS. 7-10, the leg portion 82 has a height 114 of between about 1 millimeter and about 20 millimeters, and preferably about 1 millimeter and about 5 millimeters. In the illustrated embodiment, the height 114 is about 4 mm below the lower edge 102 of the collar portion 52 of the connector assembly 26, when the locking pin 56 is in the locked position. When the cascading collapse initiates, the leg portion 82 of the actuator 72 can therefore move a distance less than 4 mm into the hollow body of the rung 24, so as to permit the upper edge 112 of the collar portion 52 of its connector assembly 26 to rest flush against the lower edge 102 of the collar portion 52 of the connector assembly 26 immediately thereabove.

FIGS. 11-14 illustrate a cascading collapse mechanism according to another embodiment. The collapsing mechanism shown in FIGS. 11-14 is identical to that shown in FIGS. 3-10, with the following exceptions. In the embodiments of FIGS. 11-14, the connector assembly 26 does not have a release button 46 (except for optionally on the lowest pair of connector assemblies on the ladder), and instead includes a shoulder portion 62 formed as a transverse pin. As is apparent from FIG. 12, the shoulder portion 62 extends through a corresponding aperture 60 on the locking pin 56. In addition, the actuator 72 is substantially enclosed within the rung portion 54 of the connector assembly, and may not protrude from a bottom surface of the connector assembly 26 or the rung 24.

Referring again to FIG. 11, the actuator 72 includes a pair of side walls 120, 122 and a bottom wall 124 surrounding the passage 90. The side walls 120, 122 are shaped so as to define the ramp surface 92 in recessed in the side walls 120, 122. The shoulder portion 62 (transverse pin) may travel on the ramp surface 92 when the locking pin 56 moves between the extended position and the retracted position. As is apparent, the locking pin 56 is in the extended position in FIG. 12, and the transverse pin is positioned near a top end 126 of the ramp surface 92. Conversely, the transverse pin may be positioned at a bottom end 128 of the ramp surface 92 when the locking pin 56 is in the retracted position.

Figure 12:
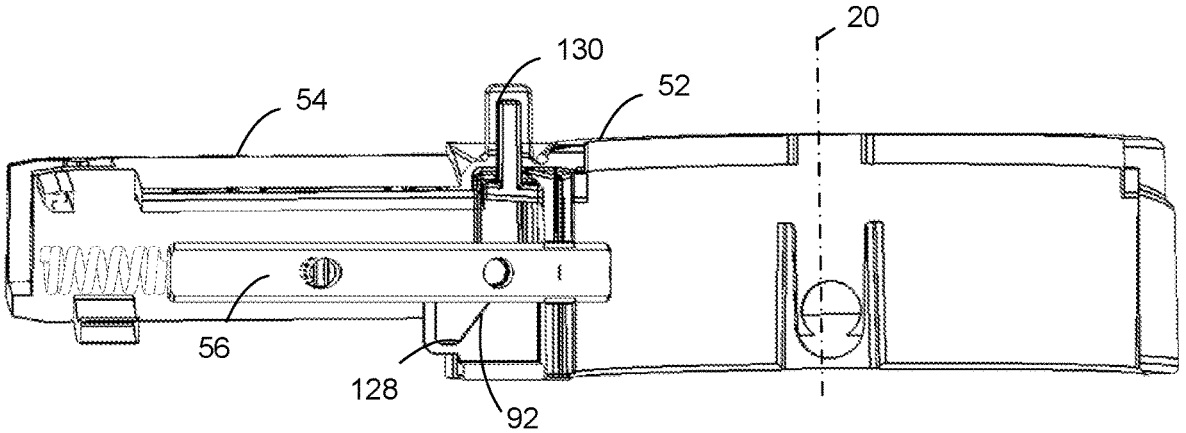
FIG. 12 is a cross-sectional view of a connector assembly showing the actuator of FIG. 11 when the locking pin is in the extended position.

Referring to FIG. 12, the connector assembly 26 includes a protrusion 130 (between the collar portion 52 and the rung portion 54) and extending in a direction parallel to the axis 20 of the columns. The protrusion 130 can be positioned at a location corresponding to external grooves 132 defined on the actuator 72. In such cases, the protrusion 130 of a first connector assembly 26 can engage against the external groove 132 of an actuator 72 positioned in a rung 24 thereabove. This engagement can initiate the cascading sequence. For example, as the protrusion 130 engages against an external groove 132 of the actuator 72 thereabove, it may provide a force that causes the locking pin 56 to retract. As a result, columns thereabove may descend, and an actuator 72 of a column above may contact a protrusion 130 of therebelow, thereby completing the cascading sequence (described, for instance, with respect to FIGS. 8 and 10). Further, disengaging the actuator 72 thereabove from the protrusion 130 therebelow may extend the locking pin 56, thereby selectively locking adjacent columns. In use, the actuator 72 of FIGS. 11-14 permits a cascading collapse identical to that described with reference to FIGS. 6-10, though, in FIGS. 6-10, the leg portion 82 of the actuator 72 protrudes below a bottom surface of a corresponding rung 24, and is pushed upward to initiate the cascade sequence. In FIGS. 11-14 the cascade sequence is initiated when the protrusion 130 of a connector assembly 26 from below is received in an external groove 132 of an actuator 72 above. That is, the actuator 72 of FIGS. 11-14 can be substantially enclosed within the rung portion 54 and/or rung 24 unlike that of FIGS. 6-10.

Figure 13:
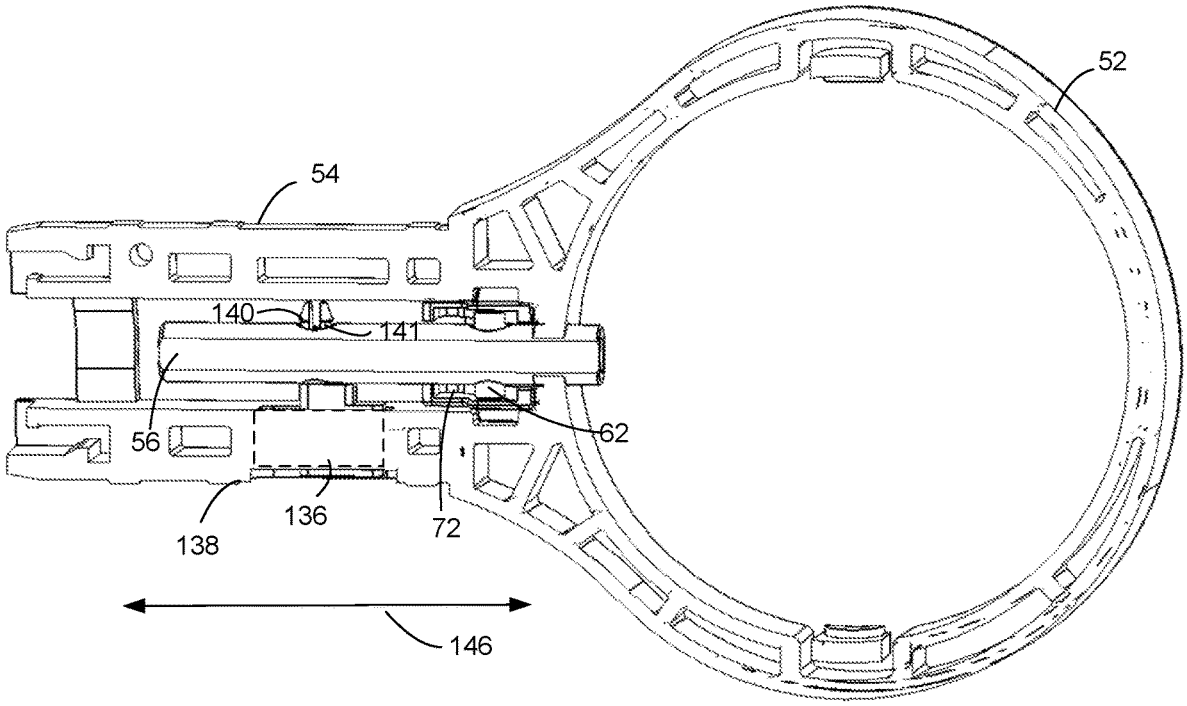
FIG. 13 is another cross-sectional view of the connector assembly of FIG. 12 taken along a sectional plane perpendicular to that of FIG. 12.

Referring to FIG. 13, connector assembly 26 includes an indicator button 136 in lieu of a release button 46 (shown, for instance, in FIGS. 3-6). The indicator button 136 may provide a visual indication (e.g., by colors, insignia, patterns or symbols), as to whether the locking pin 56 is in the extended or retracted state. As seen from FIG. 13, the indicator button 136 can be recessed from a front surface 138 of the rung portion 54 of the connector assembly 26 so as to facilitate ease of insertion of the rung portion 54 into a rung 24. The indicator button 136 can be connected to the locking pin 56 by way of a pair of connector pins 140 that can be received through apertures 141 on the locking pin 56, such that the indicator button 136 can move in a direction parallel to the locking pin 56 when the latter moves between the extended position and the retracted position.

Figure 14:
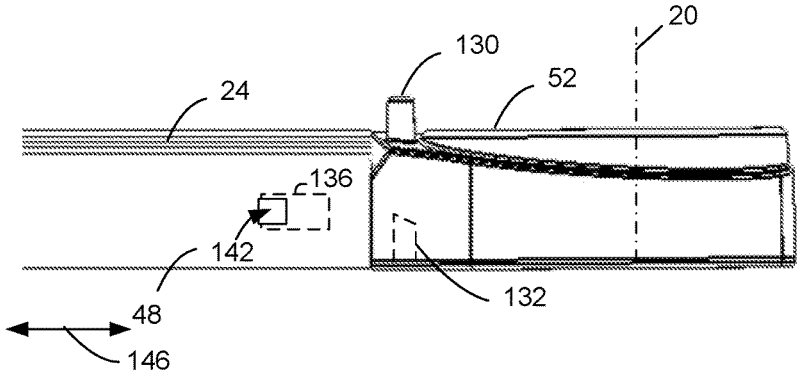
FIG. 14 is a front view of a portion of a rung connected to the connector assembly of FIG. 12.

Referring now to FIG. 14, when the rung portion 54 is inserted into a rung 24, the indicator pin may be visible from a viewing window 142 on the rung 24. In the illustrated example, the viewing window 142 is provided on the front surface 48 of the rung 24. With continued reference to FIG. 14, and referring back to FIG. 13, the indicator button 136 moves in a direction 146 parallel to the front surface 138 of the rung 24 between the extended and the retracted position of the locking pin 56. Correspondingly, different portions of the indicator button 136 may be aligned with the viewing window 142. If for instance, the locking pin 56 is in the extended position, a first portion of the indicator button 136 may be aligned with the viewing window 142, and if the locking pin 56 is in the retracted position, a second portion of the indicator button 136 may be aligned with the viewing window 142. The first portion and the second portion can each be provided with different visual indicators (colors, patterns, symbols, text and the like), so as to permit indication of whether the locking pin 56 is in the extended position or the retracted position.

As is apparent to one skilled in the art, embodiments such as those illustrated herein also prevent columns 18 from being extended except in from a preferred order. For instance, the collapsing mechanism 70 prevents columns 18 in the middle from being extended before columns 18 below the middle columns 18 are extended. For instance, if one were to extend columns 18 in the middle out of sequence, because of the columns 18 nested within the middle columns 18, the locking pin 56 may not protrude through the openings 66 to selectively lock the axial motion therebetween. Accordingly, in using some embodiments of the ladders disclosed herein, the column 18 closest to the bottom-most column may be extended first, then the columns 18 above it, allowing the column 18 closest to the bottom-most column to be locked, as its openings 66 for receiving the locking pin 56 are no longer obstructed by the columns 18 from above.

Embodiments such as those illustrated herein can be used independently or in addition to retaining mechanisms that permit a user to extend each subsequent nested column in a sequential manner such that columns 18 in the lower portion 23 are extended first prior to columns 18 in the upper portion 22 of the ladder 10. An example of such a ladder 10 with retaining mechanisms can be found in the U.S. Provisional Application Ser. No. 62/232,686, filed on Sep. 25, 2015 and assigned to the assignee of the instant application, the disclosure of which is hereby incorporated by reference in its entirety. Such embodiments offer improved stability and comply with various regulations to provide safe and efficient use of the ladder 10.

Embodiments disclosed herein teach one or more advantages. Ladders such as those disclosed herein can permit a user to collapse each subsequent nested column 18 in a sequential manner such that columns 18 in the lower portion 23 collapse first, followed by columns 18 thereabove. Such a cascading collapse of columns 18 can comply with safety regulations. Unlike known cascading collapse mechanisms, the present disclosure teaches collapsing mechanisms 70 that are simpler in construction and can easily be used in existing telescoping ladders without much modification to the construction of the ladder 10. Moreover, the construction of connector assemblies 26 of the present disclosure are much simpler, and do not require levers and the like. Also, housing the actuator 72 within the rung 24 such that the actuator 72 does not protrude from the rung 24 allows for the ladder 10 to be collapsed to have the collar portions of connector assembly 26 of adjacent rungs 24 rest flush against each other.

Various examples have been described. These and other examples are within the scope of the following claims.

The invention claimed is:

1. A telescoping ladder, comprising:

a first stile, a second stile, the first and second stiles each having a plurality of columns disposed in a nested arrangement for relative axial movement in a telescopic fashion along an axis of the plurality of columns between a fully-extended position and a collapsed position, wherein, each column having a hollow body, such that when the ladder is collapsed from the fully-extended position, each column substantially nests within another column;

a plurality of rungs extending between the first stile and the second stile, each rung connected to a column of the first stile and a column of the second stile, each rung having a hollow body;

a plurality of connector assemblies, each connector assembly comprising a collar portion and a rung portion, the collar portion generally surrounding a corresponding column, the rung portion engaging with an end of a corresponding rung, each connector assembly comprising a latch assembly having a locking pin moveable between an extended position or a retracted position for extending into or retracting out of openings of adjacent columns to selectively lock or release the columns respectively, wherein when the each locking pin is in the extended position, the adjacent columns are selectively locked, and relative axial movement between the adjacent columns is prevented and when each locking pin is in the retracted position, the adjacent columns are released and relative axial movement between the adjacent columns is permitted; and a plurality of actuators, each actuator being operatively coupled to a corresponding locking pin such that when actuated, the corresponding locking pin moves from the extended position to the retracted position, each actuator having a pair of side walls, each side wall including an inner side wall surface and an outer side wall surface opposite the inner side wall surface, each actuator including a passage configured to receive the respective locking pin between its extended position and retracted position, the passage being defined between the inner side wall surfaces of the pair of side walls, the side walls each being shaped so as to define a ramp surface recessed in the inner side wall surface and spaced apart from the outer side wall surface, each connector assembly having a shoulder portion extending from the corresponding locking pin, the ramp surface of each actuator permitting travel of the shoulder portion of the corresponding locking pin, such that a movement of each actuator in a direction parallel to the axis of the plurality of the columns is coupled to a movement of the corresponding locking pin between the extended position and the retracted position in a direction perpendicular to the axis of the plurality of columns, to lock or release the adjacent columns, whereby the plurality of actuators permit collapsing the ladder in a sequential manner, the sequence involving collapsing the columns on a lower portion of the ladder prior to collapsing columns immediately thereabove.

2. The telescoping ladder of claim 1, wherein the rung portion of each connector assembly comprises a hollow body portion, each actuator being received within the hollow body portion of a corresponding rung portion.

3. The telescoping ladder of claim 2, wherein each collapsing actuator is positioned so as to abut a portion of a corresponding collar portion of a corresponding connector assembly.

4. The telescoping ladder of claim 3, wherein at least a portion of each actuator contacts a surface of the corresponding rung when each connector assembly restricts relative axial movement between the adjacent columns.

5. The telescoping ladder of claim 4, wherein the plurality of connector assemblies includes:

a first connector assembly having a first latch assembly coupled to a first column and a first rung, and a second connector assembly having a second latch assembly coupled to a second column, the first column being positioned above the second column when the columns are in the fully-extended position, and a first actuator positioned in the first rung contacts at a portion of the second connector assembly when a second locking pin of the second connector assembly is in the retracted position.

6. The telescoping ladder of claim 5, wherein a bottom portion of the first actuator contacts a top portion of the second connector assembly when in the collapsed position.

7. The telescoping ladder of claim 6, wherein the bottom portion of the first actuator protrudes past a bottom surface of the first rung and toward a second rung.

8. The telescoping ladder of claim 6, wherein contact between the first actuator and the second connector assembly releases the first latch assembly to permit relative sliding between the adjacent columns to which the first latch assembly connects.

9. The telescoping ladder of claim 1, wherein each actuator being fork-shaped having a body portion received within the corresponding connector assembly and a leg portion protruding out of a bottom surface of a corresponding rung.

10. The telescoping ladder of claim 9, wherein the passage is further defined by edges that form the ramp surface.

11. The telescoping ladder of claim 9, wherein each actuator comprises a ledge defined between the body portion and the leg portion, the ledge being positioned to abut the bottom surface of the corresponding rung when the corresponding locking pin is in the extended position, and the ledge being spaced apart from the bottom surface of the corresponding rung in a direction parallel to the axis of the columns when the corresponding locking pin is in the retracted position.

12. The telescoping ladder of claim 11, wherein each ledge is moved away from its position contacting the bottom surface when the corresponding column connected to the corresponding rung slides relative to and/or collapses into an adjacent column therebelow.

13. The telescoping ladder of claim 12, wherein each actuator is cooperatively coupled to the corresponding locking pin such that the movement of the ledge away from the bottom surface of the corresponding rung retracts the corresponding locking pin, whereby retraction of the corresponding locking pin permits relative axial movement between the adjacent columns locked by the corresponding locking pin.

14. A telescoping ladder, comprising:

a first stile, a second stile, the first and second stiles each having a plurality of columns disposed in a nested arrangement for relative axial movement in a telescopic fashion along an axis of the plurality of columns between a fully-extended position and a collapsed position, wherein, each column having a hollow body, such that when the ladder is collapsed from the fully-extended position, each column substantially nests within another column;

a plurality of rungs extending between the first stile and the second stile, each rung connected to a column of the first stile and a column of the second stile, each rung having a hollow body;

a plurality of connector assemblies, each connector assembly comprising a latch assembly having a locking pin operatively coupled to a release button, each locking pin being moveable between an extended position and the retracted position to permit selectively locking or releasing the columns respectively; and a plurality of actuators, each actuator being configured to actuate a corresponding locking pin such that when actuated, the corresponding locking pin moves from the extended position to the retracted position, each actuator having a pair of side walls, each side wall including an inner side wall surface and an outer side wall surface opposite the inner side wall surface, each actuator including a passage configured to receive the respective locking pin between its extended position and retracted position, the passage being defined between the inner side wall surfaces of the pair of side walls, the side walls each being shaped so as to define a ramp surface recessed in the inner side wall surface and spaced apart from the outer side wall surface, the ramp surface permitting travel of a portion of a corresponding release button thereon, such that a movement of each actuator in a direction parallel to the axis of the plurality of the columns is coupled to a movement of the corresponding release button between the extended position and retracted position in a direction perpendicular to the axis of the plurality of columns, to lock or release the adjacent columns, whereby the plurality of actuators permit collapsing the ladder in a sequential manner, the sequence involving collapsing the columns on a lower portion of the ladder prior to collapsing columns immediately thereabove.

15. A telescoping ladder, comprising:

a first stile, a second stile, the first and second stiles each having a plurality of columns disposed in a nested arrangement for relative axial movement in a telescopic fashion along an axis of the plurality of columns between a fully-extended position and a collapsed position, wherein, each column having a hollow body, such that when the ladder is collapsed from the fully-extended position, each column substantially nests within another column;

a plurality of rungs extending between the first stile and the second stile, each rung connected to a column of the first stile and a column of the second stile, each rung having a hollow body;

a plurality of connector assemblies, each connector assembly comprising a latch assembly having a locking pin moveable between an extended position or a retracted position for extending into or retracting out of openings of the adjacent columns to selectively lock or release the columns respectively, wherein when the each locking pin is in the extended position, the adjacent columns are selectively locked, and relative axial movement between the adjacent columns is prevented and when each locking pin is in the retracted position, the adjacent columns are released and relative axial movement between the adjacent columns is permitted; and a plurality of actuators, each actuator having a bottom wall, and a pair of side walls perpendicular to the bottom wall, each side wall including an inner side wall surface and an outer side wall surface opposite the inner side wall surface, each actuator including a passage configured to receive the respective locking pin between its extended position and retracted position, the passage being defined between the inner side wall surfaces of the pair of side walls, the side walls each being shaped so as to define a ramp surface recessed in the inner side wall surface and spaced apart from the outer side wall surface, each locking pin having a transverse pin passing therethrough, the transverse pin being slidable on the ramp surface of a corresponding actuator so as to provide a slidable engagement of the locking pin and the corresponding actuator, whereby the slidable engagement of each locking pin and the corresponding actuator permitting retraction of each locking pin so as to permit relative axial movement between the adjacent columns connected to each locking pin, whereby the plurality of actuators permit collapsing the ladder in a sequential manner, the sequence involving collapsing the columns on a lower portion of the ladder prior to collapsing columns immediately thereabove.

16. The telescoping ladder of claim 15, further comprising an indicator button operatively coupled to each locking pin, portions of the indicator button being configured to align with a viewing window, the indicator window being slidable relative to the viewing window so as to provide a visual indication of whether the locking pin is in the extended position or in the retracted position.

17. The telescoping ladder of claim 15, wherein each actuator comprises an external groove, and each connector assembly comprises a protrusion, such that the external grooves of a first actuator of a first connector assembly connected to a first rung being configured to receive the protrusion of a second connector assembly, the second connector assembly being positioned in a second rung below the first rung.

18. The telescoping ladder of claim 17, wherein the protrusion of the second connector assembly engages with the external grooves of the first actuator when the first rung moves toward the second rung in the collapsed position.

19. The telescoping ladder of claim 18, wherein the engagement of the external groove with the protrusion exerts a force to release the locking pin from the extended position into the retracted position, thereby initiating cascading collapse in the sequential manner.

20. The telescoping ladder of claim 17, wherein disengagement of the protrusion from the external groove results in movement of the locking pin from the retracted position into the extended position.

21. The telescoping ladder of claim 14, wherein only the connector assemblies of lowermost portion of the ladder are provided with the release button.

22. The telescoping ladder of claim 14, wherein the release button is provided on every connector assembly.

* * * * *